US006202740B1

(12) United States Patent
Brücher et al.

(10) Patent No.: US 6,202,740 B1
(45) Date of Patent: Mar. 20, 2001

(54) HEAT EXCHANGER WITH A CONNECTION

(75) Inventors: Peter Brücher, Oranienburg (DE); David J. Brown, Houston; John R. Brewer, Katy, both of TX (US)

(73) Assignee: Borsig GmbH, Berlin (DE)

( * ) Notice: Subject to any disclaimer, the term of this patent is extended or adjusted under 35 U.S.C. 154(b) by 0 days.

(21) Appl. No.: 09/375,096

(22) Filed: Aug. 16, 1999

(30) Foreign Application Priority Data

Oct. 16, 1998 (DE) ..... 198 47 770

(51) Int. Cl.[7] ..... F28F 9/02
(52) U.S. Cl. ..... 165/158; 165/134.1
(58) Field of Search ..... 165/158, 135, 165/136, 134.1, 174, 178

(56) References Cited

U.S. PATENT DOCUMENTS 3,374,832 * 3/1968 Tucker ..... 165/158 X
4,182,407 * 1/1980 Lagerwerf et al. ..... 165/178 X
4,585,057 * 4/1986 Marburger ..... 165/158 X
4,720,251 * 1/1988 Mallay et al. ..... 165/158 X
5,570,741 * 11/1996 Brucher et al. ..... 165/158 X
5,813,453 * 9/1998 Brucher ..... 165/158 X
5,816,322 * 10/1998 Albano et al. ..... 165/134.1 X

* cited by examiner

*Primary Examiner*—Allen Flanigan
*Assistant Examiner*—Ljiljana V. Ciric
(74) *Attorney, Agent, or Firm*—Max Fogiel

(57) ABSTRACT

A heat exchanger with a connection that connects an uncooled pipe to several cooled pipes. The connection (3) has a cylindrical intake section that communicates with the uncooled pipe (2) and merges into an outward-tapering terminating section (9. The terminating section encloses several gas-conveying channels. Each gas-conveying channel extends out of the intake section coaxial to one of the cooled pipes (4). The gas-conveying channels (10) branch out in the shape of a star from the connection's intake section (8). The cooled pipes are inserted into a base (6) and arrayed along a segment of a circle. The gas-conveying channels are arrayed along the same segment.

7 Claims, 1 Drawing Sheet

HEAT EXCHANGER WITH A CONNECTION

BACKGROUND OF THE INVENTION

The present invention concerns a heat exchanger with a connection that connects an uncooled pipe to several cooled pipes.

Heat-exchanger connections wherein the heat-insulated end of a hot and uncooled pipe bifurcates outward are known (German Patent 3910630). The connection conveys the hot gas into a single pipe that is cooled from outside, by boiling water for example. The principle has been proven. Still, it is considered more or less of a drawback that the cooled pipe must be relatively long because of its considerable width, approximately the same as that of the uncooled pipe. This is because of the thermodynamics involved in cooling the gas to a specific desired temperature.

The cooled pipe can be considerably shorter and the heat exchanger accordingly more cost effective when the hot fluid from the single uncooled pipe is distributed to several cooled pipes. Designs of this genus are known wherein hot fluid deriving from an intake is distributed by way of an intake chamber to a number of cooled pipes secured in s single floor. There is, however, a drawback to this system in that the fluid becomes turbulent as it reaches the floor and tends to erode it. U.S. Pat. No. 5,464,057 discloses a heat exchanger of doubled-walled pipe that communicates with a header in the form of a pipe with an elliptical cross-section. There is an intake at the end of the heat exchanger where the gas enters. The intake accommodates several gas channels, each communicating with a gas-supply pipe. Each gas channel tapers out downstream and distributes the hot incoming gas to several cooled pipes. Drawbacks to this heat exchanger are its extreme length and that each cooled pipe requires a separate jacket to accommodate the coolant. Furthermore, the intake is complicated and accordingly expensive.

Another known heat exchanger of double-walled pipe employs a connection in the form of a siphon pipe that branches into two or three legs with no change in the overall cross-section. Each leg is assigned to one of the double-walled pipes. This heat exchanger has basically the same drawbacks as the one described in U.S. Pat. No. 5,464,057.

SUMMARY OF THE INVENTION

The object of the present invention is accordingly a heat exchanger of the aforesaid genus that will distribute hot fluid from an uncooled pipe to several cooled pipes by way of a simple, cost-effective, and compact and space-saving connection without the base being subjected to turbulence from the direct impact of the fluid.

Distributing the gas-conveying channels and their associated cooled pipes over the smallest possible containable area allows the channels to be provided with a single and preferably cylindrical jacket. The cooled pipes can also extend through a single outer jacket. The heat exchanger can accordingly be space-saving, cylindrical, and cost-effective.

BRIEF DESCRIPTION OF THE DRAWINGS

One embodiment of the present invention will now be specified with reference to the attached drawing, wherein.

DESCRIPTION OF THE PREFERRED EMBODIMENTS

Figure 1:
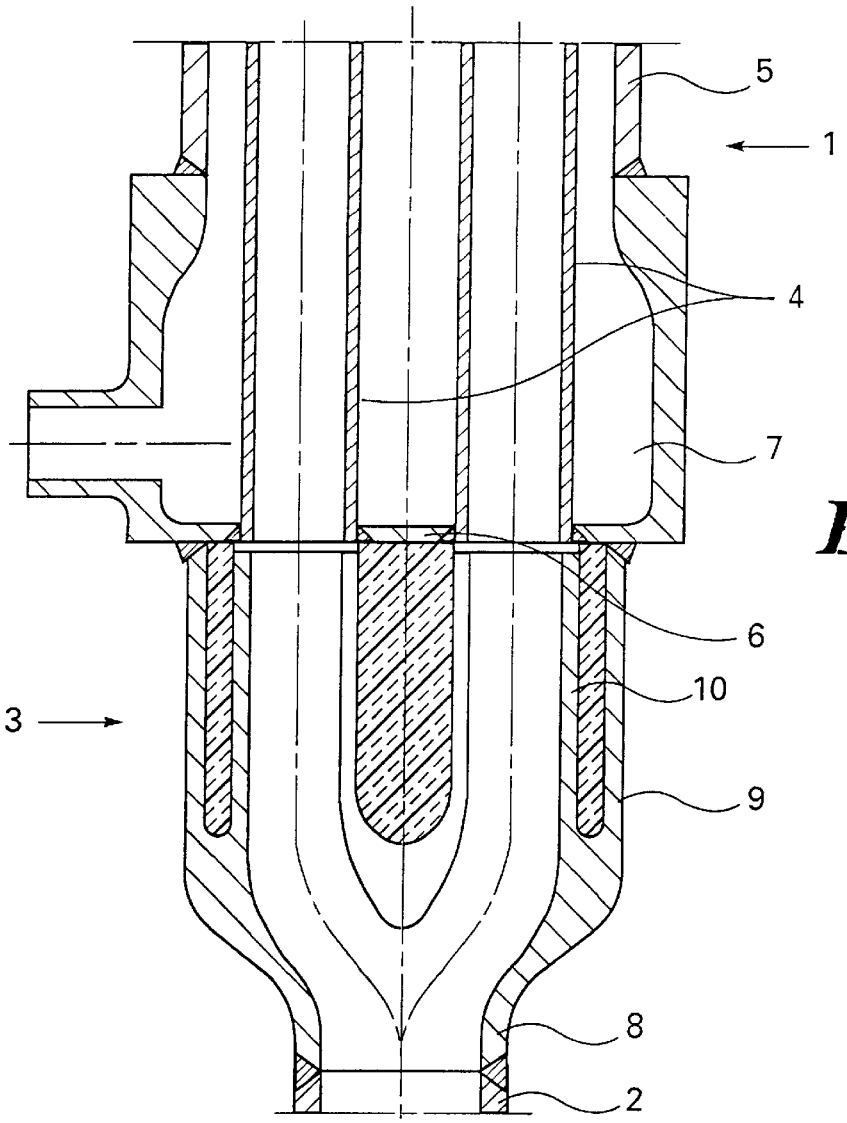
FIG. 1 is a longitudinal section through the bottom of a heat exchanger and connection and FIG. 2 is a top view of the connection.
Figure 2:
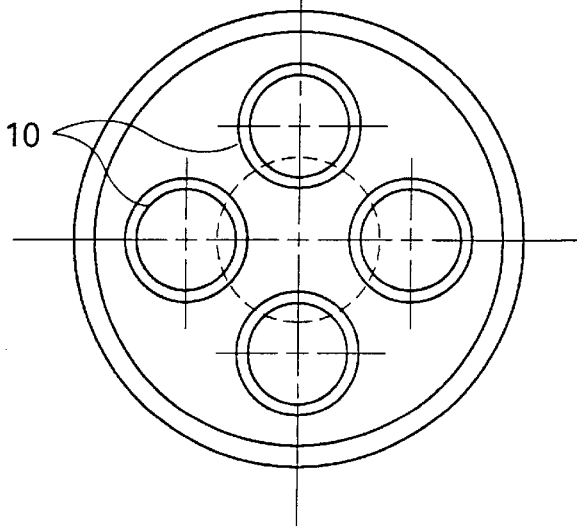

The only partly illustrated heat exchanger 1 is employed to cool a hot gas using a coolant, preferably boiling water.

The gas has preferably been cracked in a cracking furnace and needs to be rapidly cooled. The gas leaves the cracker through at least one uncooled pipe 2, each of which communicates with heat exchanger 1 through a connection 3.

Heat exchanger 1 comprises several, four for instance, cooled pipes 4, each with an inside diameter shorter than that of the uncooled pipe. Cooled pipes 4 are distributed in a circle, enclosed in a cylindrical outer jacket 5, and welded to a base 6. Cooled pipes 4 extend through a coolant intake chamber 7 that rests on and is welded to base 6 with its other end welded to outer jacket 5. At the other, unillustrated, end of heat exchanger 1 cooled pipes 4 are secured to another floor and enclosed in a coolant-outlet chamber.

Connection 3 has a cylindrical intake section 8 of the same inside diameter as that of uncooled pipe 2, to which it is secured, welded for example. Intake section 8 tapers out into a cylindrical terminating section 9.

The intake section 8 of connection 3 branches into several gas-conveying channels 10 arrayed in the shape of a star and accommodated in terminating section 9, each channel communicating coaxially with a cooled pipe 4 and distributed at the same points around the circle. The inside diameter of each cooled pipe 4 is as long as or longer than that of each gas-conveying channel 10.

Terminating section 9 is welded to the base 6 that cooled pipes 4 rest on. A gap has been left between the adjacent faces of gas-conveying channels 10 and cooled pipes 4 to allow expansion subject to heat.

The space between gas-conveying channels 10 and terminating section 9 is packed with heat insulation. Connection 3 can be either cost-effectively cast in one piece from a metallic and heat-resistant material or welded together from several parts.

The connection 3 specified herein will convey the hot gas to cooled pipes 4 with little turbulence. The matching inside diameters and outer contours of gas-conveying channels 10 and cooled pipes 4 will prevent the gas from becoming turbulent, and base 6 will not be subject to wear.

What is claimed is:

1. A heat exchanger with a connection connecting an uncooled pipe to a plurality of cooled pipes, comprising: a cylindrical intake section on said connection and communicating with the uncooled pipe, said cylindrical intake section merging into an outward-tapering terminating section; a plurality of gas-conveying channels enclosed by said terminating section, each of said gas-conveying channels extending out of said intake section coaxial to one of said cooled pipes, said gas-conveying channels branching out from said intake section; a base, said cooled pipes inserted into said base and arranged along a segment of a circle, said gas-conveying channels being arrayed along the same segment; and a single cylindrical outer jacket enclosing all said cooled pipes.

2. A heat exchanger as defined in claim 1, wherein said cylindrical outer jacket is secured to said base.

3. A heat as defined in claim 1, wherein said terminating section is cylindrical.

4. A heat exchanger as defined in claim 1, wherein said terminating section communicates with said base supporting said cooled pipes.

5. A heat exchanger as defined in claim 1, including heat insulation packed in a space between said terminating section and said gas-conveying channels.

6. A heat exchanger as defined in claim 1, wherein each gas-conveying channel has an inside diameter and said uncooled pipe has an inside diameter, the inside diameter of each gas-conveying channel being shorter than the inside diameter of said uncooled pipe.

7. A heat exchanger as defined in claim 1, wherein each cooled pipe has an inside diameter and each of said gas-conveying channels has an inside diameter, the inside diameter of each cooled pipe being at least as long as the inside diameter of any one of said gas-conveying channels.

* * * * *